US005548987A

United States Patent [19]

Häusler

[11] Patent Number: 5,548,987

[45] Date of Patent: Aug. 27, 1996

[54] ROLL MANDREL MONITORING ARRANGEMENT IN COLD PILGER MILLS

[75] Inventor: Karl H. Häusler, Korschenbroich, Germany

[73] Assignee: Mannesmann Aktiengesellschaft, Dusseldorf, Germany

[21] Appl. No.: 301,692

[22] Filed: Sep. 7, 1994

[30] Foreign Application Priority Data

Sep. 7, 1993 [DE] Germany ..... 43 30 932.1

[51] Int. Cl.[6] ..... B21B 17/10

[52] U.S. Cl. ..... 72/208; 72/6.2; 72/14.3; 324/229; 324/262

[58] Field of Search ..... 72/6, 26, 208; 326/226, 229, 239, 262

[56] References Cited

U.S. PATENT DOCUMENTS 4,429,561 2/1984 Ramnesten ..... 72/208

5,066,913 11/1991 Catanese ..... 324/226

5,418,456 5/1995 Cook et al. ..... 324/227

FOREIGN PATENT DOCUMENTS 710689 1/1981 U.S.S.R. ..... 72/208

*Primary Examiner*—W. Donald Bray

*Attorney, Agent, or Firm*—Cohen, Pontani, Lieberman, Pavane

[57] ABSTRACT

A roll mandrel monitoring device in cold pilger mills with a coil which surrounds the rolled tube concentrically and is arranged on the delivery side after the rolling mill for detecting longitudinal movement of a coil core which is fastened inside the tube to a bar extending between the mandrel and coil coaxially to the tube. In order to achieve faster reaction times and accordingly to stop the rolling mill when the mandrel breaks, the bar is connected with the mandrel rod holding the mandrel so as to penetrate the mandrel concentrically and is constructed in the region of the mandrel as a tension bar which can be pretensioned against the end of the mandrel on the delivery side with the intermediary of an energy accumulator.

9 Claims, 1 Drawing Sheet

ROLL MANDREL MONITORING ARRANGEMENT IN COLD PILGER MILLS

BACKGROUND OF THE INVENTION

1. Field of the Invention

The invention is directed to a monitoring arrangement for the roll mandrel in a cold pilger mill. The monitor arrangement includes a coil which surrounds the rolled tube concentrically and is arranged on the delivery side after the rolling mill for detecting longitudinal movement of a coil core which is fastened inside the rolled tube to a bar extending between the mandrel and coil coaxially to the tube. Devices for processing the detected movement of the core in the coil are provided to generate a signal by means of which the rolling mill can be stopped.

2. Discussion of the Prior Art

As is well known in the cold pilger rolling art, a metal tube blank is elongated by degrees over a conical roll mandrel and shaped into a tube having a smaller diameter and a smaller wall thickness. In so doing, the roll mandrel is held in position by a mandrel rod. The mandrel rod itself is held in a mandrel rod abutment. The roll mandrel is highly stressed by the rolling force and the friction of the rolling stock and often breaks at different locations. The broken off part then moves along with the tube in the rolling direction. This can damage the rolling mill particularly when the thick part of the roll mandrel wanders into the smaller pass opening of the smoothing rolls which could cause the rolls to spring apart and break.

If the roll mandrel breaks in its thin portion, i.e., in the smoothing pass, the break may not even be noticed in certain cases and the rolled tube or even a number of rolled tubes may have to be scrapped. It may also happen that the roll mandrels themselves are rolled out when the rolling force is too high and high-strength tube material is used. In this case, the roll mandrels are made thinner and the wall of the tube diverges from permissible tolerances. This always leads to a stoppage of the rolling plant and to unacceptable costs.

A roll mandrel monitoring arrangement of the type described above is known, for example, from DE-OS 25 48 379. In this case, a rod carrying a magnetic core at its free end is screwed into the mandrel on the delivery side. If the mandrel breaks, the magnetic core wanders under a coil surrounding the tube and is detected by the coil. This generates an error signal which is used to stop the rolling mill.

A disadvantage of this known arrangement is that the magnetic core must first travel a certain distance under the coil before this coil is activated. Consequently, valuable time is wasted and the machine is sometimes stopped too late to avoid damage and/or significant waste.

SUMMARY OF THE INVENTION

Accordingly, it is an object of the present invention to improve the mandrel breakage safety device known from DE-OS 25 48 379 so that the rolling mill can be stopped more quickly with shorter reaction times and disturbances can be detected at the mandrel before the rolling mill is damaged and before a greater quantity of tube is rolled.

Pursuant to this object, and others which will become apparent hereafter, one aspect of present invention resides in connecting the bar with the mandrel rod holding the mandrel so that the bar passes through the mandrel concentrically and constructing the bar in the region of the mandrel as a tension bar which can be pretensioned against the end of the mandrel on the delivery side with the intermediary of an energy accumulator.

In a departure from the teaching of the prior art in which the bar is inserted into the end side of the mandrel, this bar is now guided through a longitudinal bore hole of the mandrel and fastened to the mandrel rod in the same location where the mandrel is screwed on. The mandrel rod is constructed as a tension bar and is pretensioned in its entirety, i.e. within the bore hole. Depending on the selected magnitude of pretensioning, the tension bar tears before or at the same time that the mandrel breaks and the interposed energy accumulator throws the severed part of the tension bar, along with the coil core, into the region of the coil causing an immediate switch-off signal therein. With a suitable adjustment of pretensioning, the tearing of the tension bar can also produce a signal for switching off the rolling mill already before the mandrel breaks by making use of the fact that the mandrel lengthens before tearing.

In a further embodiment of the invention the tension bar is provided with a predetermined breaking point. This predetermined breaking point enables a more accurate adjustment of the tearing force and accordingly improves adjustment of the roll mandrel monitoring arrangement for indicating defects.

According to another feature of the invention, the pretensioning of the energy accumulator can be adjusted.

According to a further feature of the invention the energy accumulator is a pressure spring which is arranged in a sleeve surrounding the bar. The length of the sleeve can be adjusted relative to the bar by turning the sleeve on a threaded part of the bar. In this way the pretensioning of the tension bar can be changed in a continuous manner and accordingly the switch-off force of the rolling mill can be adjusted.

Pursuant to yet another feature of the invention, the tension bar is preferably guided in a bush so as to be fixed with respect to rotation relative thereto, which bush is screwed into the end of the mandrel on the delivery side, the free end side of this bush forming the abutment for the pressure spring and sleeve. By adjusting the bush and the sleeve, the switch-off force resulting from the tearing of the tension bar can be adjusted more precisely. It is also possible to adjust a region of play within which the bar can move without tearing. In this way the switch-off point of the rolling mill can be deliberately delayed and adapted to given requirements.

In an advantageous further embodiment, the tension bar is provided with a collar on the side of the predetermined breaking point remote of the mandrel rod, the diameter of the collar being greater than the inner diameter of the bush guiding the tension bar. In this way the path of the tension bar severed at the predetermined breaking point is defined within the tube for protective purposes. Thus, the severed portion of the tension bar advances only until the collar comes to a stop at the bush. The corresponding path is so dimensioned that the core remains in the region of the coil when the collar contacts the bush. When the safety device is adjusted in such a way that the tearing of the tension bar occurs when the mandrel has lengthened beyond a permissible point before breaking, the position of the core in the coil can produce a permanent signal which is detected as an indication of the lengthening of the mandrel.

In another embodiment of the invention the tension bar has a square or hexagonal cross section along most of its length. This step allows the broken off tension bar to be unscrewed from the mandrel rod with a socket wrench without having to unscrew the roll mandrel.

Finally, the position of the core can be arranged so as to be adjustable in the longitudinal direction of the bar for a precise adjustment of the signal generated by the coil.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The drawing shows a cross section through a tube blank and the roll mandrel monitoring device according to the present invention.

DETAILED DESCRIPTION OF THE PREFERRED EMBODIMENTS

Figure 1:
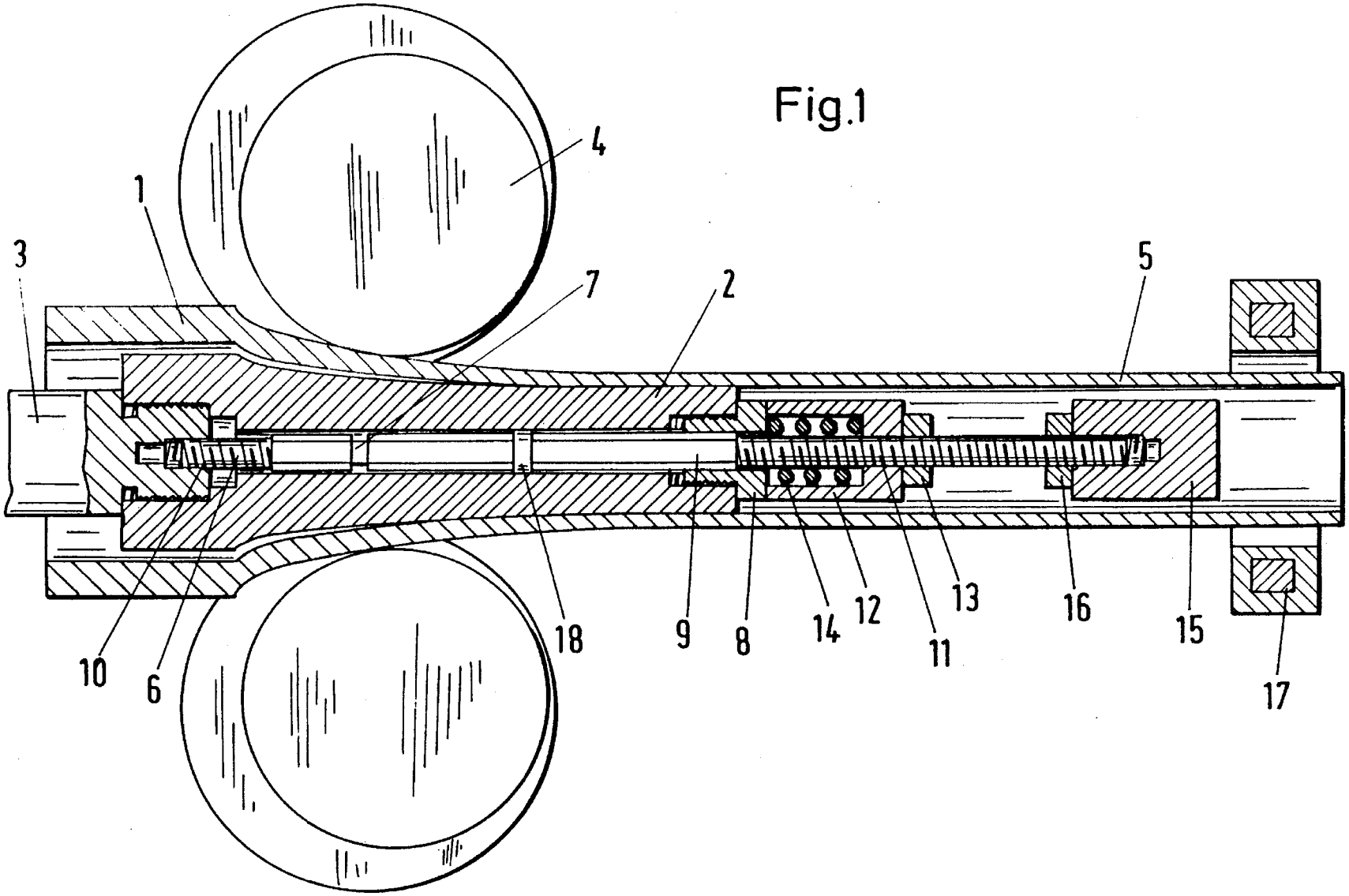

As seen in the drawing, a roll mandrel 2 is screwed to the end of a mandrel rod 3 on the entering side of the mandrel. The rolls 4 roll back and forth along the roll mandrel 2 during the rolling process and shape a tube blank 1 into a tube or pipe 5. The tension bar 6 according to the invention which is made of brittle material is screwed into the mandrel rod 3 at the end side and has a predetermined breaking point 7. The tension bar 6 slides in a bush 8 which is screwed at the end side into a portion of the roll mandrel 2 on the delivery side and is provided with a square or hexagonal bore hole corresponding to the outer circumference of the tension bar 6. The tension bar 6 is accordingly secured against rotation and cannot detach itself from the thread type connection 10 with the mandrel rod 3.

A sleeve 12 is screwed onto another threaded portion 11 of the tension bar 6 and is secured by a nut 13. The sleeve 12 is pressed away from the roll mandrel 2 by a helical spring 14. The magnetic core 15 is screwed on the same threaded portion 11 of the extension of the tension bar 6 and is also secured by a nut 16. The coil 17 surrounding the pipe 5 is arranged as close as possible to the core 15.

Further, a collar 18, whose outer circumference is greater than the inner diameter of the bush 8, is arranged on the tension bar 6.

In order to assemble the roll mandrel monitoring device, the threaded stem 10 of the tension bar 6 is first screwed into the threaded hole of the mandrel rod 3 by approximately one turn. The bush 8 is then slipped over the hexagon 9, screwed into the roll mandrel and tightened. At the same time, due to the hexagonal configuration of the bore hole of the bush 8 and the hexagon 9 of the tension bar 6, the tension bar 6 is screwed loosely into the thread of the mandrel rod 3. After attaching the helical spring 14, the sleeve 12 is screwed on up to the bush 8, which forms an abutment, and secured by the nut 13. It is possible to adjust a preselected play by means of the sleeve 12. For this purpose, the sleeve 12 is screwed on at a distance from the bush 8 corresponding to the degree of play. In this way the roll mandrel 2 can be lengthened by a certain extent before the safety device responds. Finally, the core 15 is screwed onto the threaded portion 11 and fixed in the appropriate position relative to the coil 17 by the nut 16.

If the roll mandrel 2 breaks or lengthens as a result of rolling, the tension bar 6 tears at the predetermined breaking point 7. The remainder of the tension bar 6 with the screwed on core 15 is thrust away from the mandrel 2 by the pretensioned pressure spring 14 and through the coil 17 which triggers a signal for stopping the machine. The core 15 is long enough to provide sufficient contact time with the coil 17. If the mandrel 2 is only lengthened beyond a permissible degree, when suitably adjusted the tension bar 6 tears before the mandrel 2 breaks and the piece of the tension bar 6 on the delivery side is thrown out by the action of the pressure spring 14, as was described above, until the front of the collar 18 stops at the bush 8. In this position, the core 15 remains within the coil 17 and produces a permanent signal which alerts the operator to that the fact that the mandrel is lengthened to an impermissible extent, but not broken. Since this lengthening goes hand in hand with pipe wall thicknesses in excess of tolerances, the machine is immediately stopped and the appropriate corrective steps are initiated.

It may come about that the roll mandrel disengages from the thread of the mandrel rod. In this case, the mandrel breakage protection device would also transmit an error message provided that the tension bar has not already been unscrewed from the mandrel rod 3. Therefore, it is advisable to provide the tension bar 6 and mandrel rod 3 with opposite threads. The tension bar 6 would then be tightened by the rotation of the mandrel 2 and would break at the appropriate time.

The piece of tension bar 6 remaining in the mandrel 2 can be unscrewed from the end of the mandrel rod 3 by means of a hexagon socket wrench without having to unscrew the roll mandrel 2 itself.

The roll mandrel monitoring device according to the invention is distinguished by extremely fast reaction times as a result of the advantageous adjustability in combination with the intermediary of the pressure spring 14. Lengthening of the mandrel can also be detected in an advantageous manner by the device according to the invention before the mandrel itself breaks.

The invention is not limited by the embodiments described above which are presented as examples only but can be modified in various ways within the scope of protection defined by the appended patent claims.

I claim:

1. A device for monitoring a roll mandrel mounted at a first end to a mandrel rod in a cold pilger rolling mill, comprising:

a bar connectable to the mandrel rod so as to penetrate the mandrel concentrically, said bar being constructed as a tension bar that can be pretensioned against a second end of the mandrel;

energy accumulator means for pretensioning the bar against the mandrel;

a coil that surrounds a rolled tube concentrically at a delivery side after the rolling mill;

a coil core fastened to a portion of the bar extending from the mandrel to the coil so as to be inside the tube, said coil detecting longitudinal movement of the coil core; and means for processing detected movement of the core to generate a signal for stopping the rolling mill.

2. A roll mandrel monitoring device according to claim 1, wherein the tension bar has a predetermined breaking point.

3. A roll mandrel monitoring device according to claim 1, wherein the energy accumulator means has an adjustable pretension.

4. A roll mandrel monitoring device according to claim 2, wherein the energy accumulator means includes a sleeve surrounding the tension bar and a pressure spring arranged in the sleeve, the bar having a threaded portion on which the sleeve is threaded so that the sleeve is adjustable relative to the bar by turning the sleeve.

5. A roll mandrel monitoring device according to claim 4, and further comprising a bush screwed into the second end of the mandrel, said bush having a free end side that forms an abutment for the pressure spring and the sleeve, the tension bar being guided in the bush so as to be rotatably fixed relative thereto.

6. A roll mandrel monitoring device according to claim 5, wherein the tension bar has a collar on a side of the predetermined breaking point remote of the mandrel rod, the collar having a diameter that is greater than an inner diameter of the bush guiding the tension bar.

7. A roll mandrel monitoring device according to claim 1, wherein the tension bar has a square cross section along at least a portion of its length.

8. A roll mandrel monitoring device according to claim 1, wherein the tension bar has a hexagonal cross section along at least a portion of its length.

9. A roll mandrel monitoring device according to claim 1, and further comprising means for adjusting the position of the core in the longitudinal direction of the tension bar.

* * * * *